United States Patent [19]

Fujii et al.

[11] 4,409,282

[45] Oct. 11, 1983

[54] NONWOVEN FABRICS

[75] Inventors: Shigeo Fujii; Tokuzo Ikeda; Takashi Mikami; Shuji Okano, all of Saitama, Japan

[73] Assignee: Toa Nenryo Kogyo Kabushiki Kaisha, Tokyo, Japan

[21] Appl. No.: 401,289

[22] Filed: Jul. 22, 1982

Related U.S. Application Data

[63] Continuation of Ser. No. 203,770, Nov. 3, 1980, abandoned, which is a continuation-in-part of Ser. No. 167,637, Dec. 21, 1979, Pat. No. 4,375,446, and Ser. No. 167,638, Dec. 21, 1979, abandoned.

[30] Foreign Application Priority Data

May 1, 1978 [JP] Japan ..... 53/50745
Nov. 1, 1979 [JP] Japan ..... 54/140439

[51] Int. Cl.[3] ..... B32B 7/04

[52] U.S. Cl. ..... 428/219; 428/220; 428/284; 428/286; 428/297; 428/298; 428/299; 428/302; 428/904

[58] Field of Search ..... 428/219, 220, 284, 286, 428/297, 298, 302, 299, 904

[56] References Cited

U.S. PATENT DOCUMENTS

| | | | |
|---|---|---|---|
| 1,532,084 | 3/1925 | Shaw | 428/299 |
| 2,434,887 | 1/1948 | Repass et al. | 428/299 |
| 3,808,095 | 4/1974 | McKnight | 428/299 |
| 4,021,593 | 5/1977 | Smith | 428/299 |

*Primary Examiner*—James J. Bell
*Attorney, Agent, or Firm*—Myron B. Kurtzman

[57] ABSTRACT

A bulky nonwoven fabric comprises fine fibers forming thin intertwined layers extending between one surface of the fabric and the other surface, that is, the layered fibers run in the direction of thickness of the fabric. The nonwoven fabric of thermoplastic resin is prepared by a melt-blowing process utilizing a drum collector and cooperating nip-roll. If desired the fiber and gas stream may be contacted with fine liquid drops.

5 Claims, 11 Drawing Figures

NONWOVEN FABRICS

This is a continuation of application Ser. No. 203,770, filed Nov. 3, 1980 abandoned which is a CIP of Ser. No. 167,637, filed Dec. 21, 1979 now U.S. Pat. No. 4,375,446 and Ser. No. 167,638, filed Dec. 21, 1979 abandoned.

BACKGROUND OF THE INVENTION AND PRIOR ART

This invention relates to a novel bulky nonwoven fabric formed by an orderly arrangement of fibers.

Many kinds of nonwoven fabrics have hitherto been developed, and are widely used for various applications.

There are, thus, various types of nonwoven fabrics, and various methods of making the same, including those known under the name of the melt-blowing method (Japanese Patent Application Laid-Open Specification No. 10258/1974), the melt-blow molding method (Japanese Patent Application Laid-Open Specification No. 46972/1975), the jet spinning method (Japanese Patent Publication No. 25871/1969), or the like. According to these methods, a thermoplastic resin is melt-spun, and blown in the form of fine fibers against a moving collector by a high-speed flow of a gas.

A study has recently come to be made about the use of the nonwoven fabrics obtained by these methods for making filter materials, carpets, synthetic leathers, or the like. However, the nonwoven fabrics prepared by any such method lack uniformity in thickness and basis weight, and are not bulky since, the fibers lie parallel to the fabric surfaces (i.e., two-dimensionally). These prior art products present various obstacles to the preparation of satisfactory products as intended, and no satisfactory carpet, leather or the like has yet been prepared from the nonwoven fabrics available in the art.

It is an object of this invention to provide a nonwoven fabric having a novel structure which eliminates the drawbacks of the nonwoven fabrics known in the art. This invention consists essentially in a nonwoven fabric comprising a plurality of stacked and intertwined long fibers defining one of cross-sectional planes extending between one surface of the fabric or a part thereof, and another surface of the fabric or a part thereof.

Figure 8:
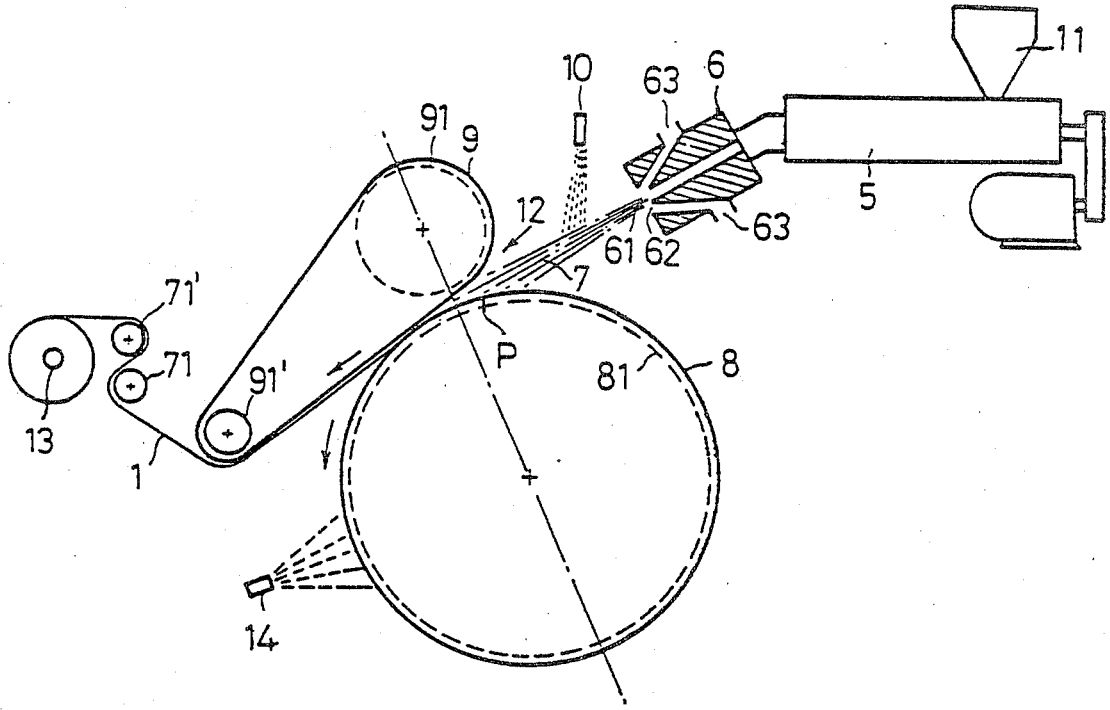
FIG. 8 is a detailed view illustrating a method of manufacturing the nonwoven fabric according to this invention.
Figure 9:
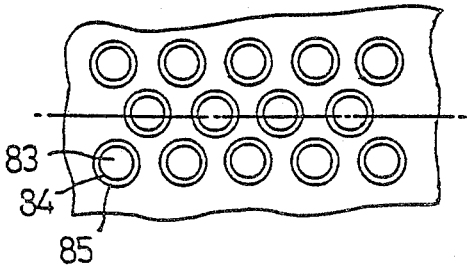
Figure 10:
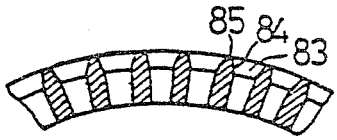
Figure 11:
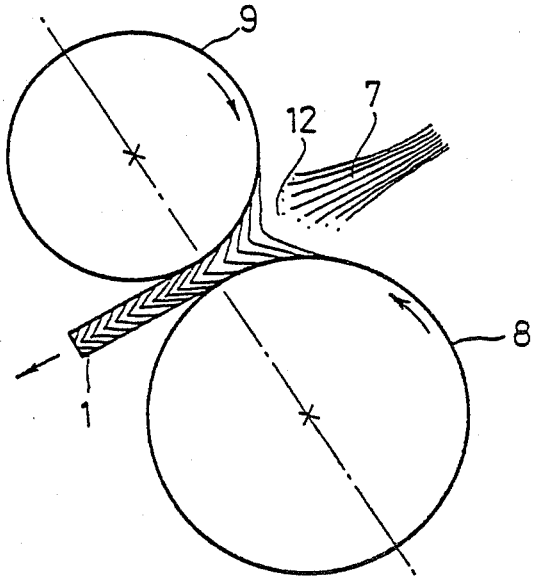

FIGS. 9 and 10 are views describing the apertures with which the side wall of the drum 81 supporting the collector 8 shown in FIG. 8 is pierced; and FIG. 11 is a view describing the process in which the nonwoven fabric is formed by the method shown in FIG. 8.

Figure 1:
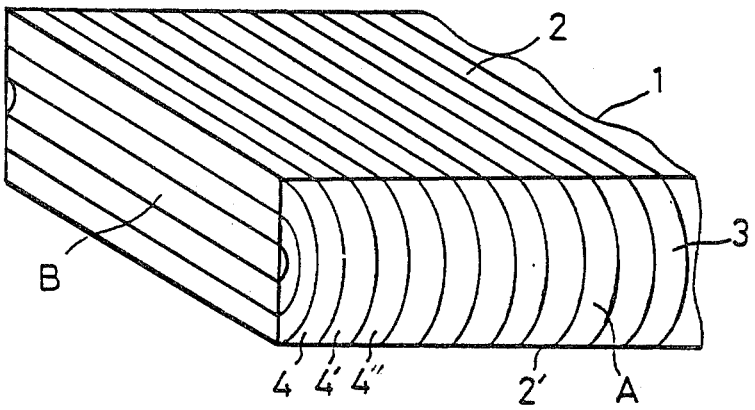
FIG. 1 is a view schematically showing a nonwoven fabric embodying this invention.

The nonwoven fabric of this invention will now be described with reference to the drawings. In FIG. 1, numerals 2 and 2' denote the opposite surfaces of the nonwoven fabric 1, letter A indicates one cross-sectional plane extending between the surface 2 or a part thereof, and the surface 2' or a part thereof (which for the sake of convenience will hereinafter be called the longitudinal sectional plane), and letter B indicates another cross-sectional plane extending between the surface 2 or a part thereof, and the surface 2' or a part thereof (which will hereinafter be called the transverse sectional plane). Numeral 3 denotes an intermediate fibrous layer disposed between the surfaces 2 and 2', and composed of a plurality of long fibers which are intertwined and stacked together. Numerals 4, 4', 4'' indicate thin layers each composed of intertwined long fibers. The thin layers 4, 4', 4'', are actually continuously combined with one another, and cannot be distinguished from one another as clearly as shown in FIG. 1, which is a schematic view provided for the convenience of illustration. However, as it is possible to divide the fabric into such layers, each having a desired thickness, FIG. 1 shows the fabric as if it were composed of clearly distinguishable layers.

Figure 2:
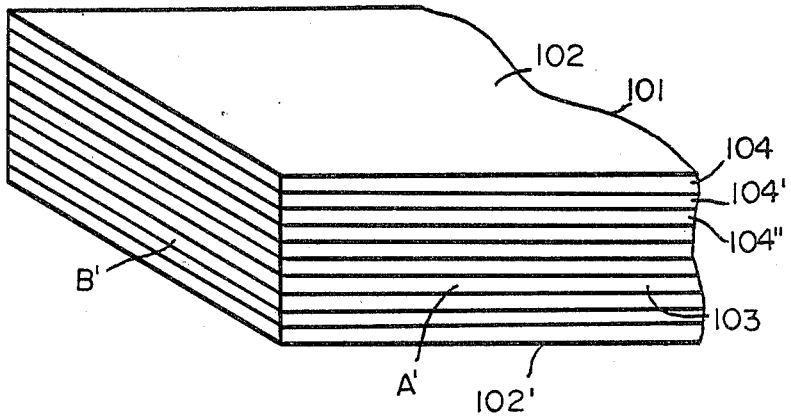
FIG. 2 is a view similar to FIG. 1 showing a nonwoven fabric known in the art.
Figure 3:
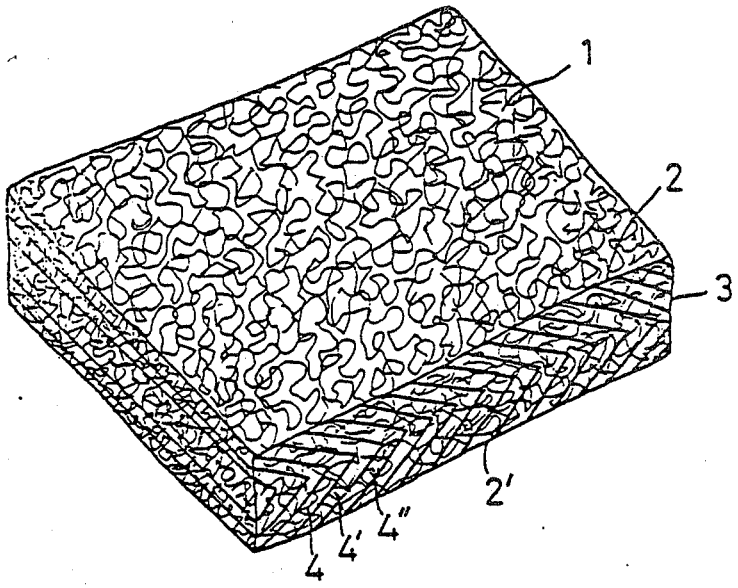
FIG. 3 is a perspective view generally showing the nonwoven fabric of this invention.

FIG. 1 shows the thin layers 4, 4', 4'', which cooperate with one another to define the surfaces 2 and 2' of the nonwoven fabric 1. This feature makes the nonwoven fabric of this invention completely different from any known nonwoven fabric having such thin layers 104, 104', 104'' lying substantially in parallel to its surfaces 102 and 102' as shown in FIG. 2.

The thin layers 4, 4', 4'' shown in FIG. 1 are each formed by a plurality of long fibers intertwined and collected on the surfaces. In other words, the thin layers are of the same construction as in the nonwoven fabrics known in the art. Accordingly, the nonwoven fabric of this invention is characterized by the single fibers lying together along the thickness of the fabric. The single fibers forming each of the thin layers are intertwined, and connected to the surfaces 2 and 2' to define them.

The structure of the nonwoven fabric according to this invention has been schematically shown in FIG. 1. FIGS. 3 to 7 show embodiments of the nonwoven fabric of the invention. FIGS. 4 to 7 illustrate the plane A of FIG. 1. FIGS. 3 to 6 show the surfaces 2 and 2' defined by surface layers composed of a multiplicity of fibers; FIG. 7 shows the surface 2 formed by long fibers exposed from the fibrous layer 3 per se. The nonwoven fabric of the type shown in FIG. 7 may also be prepared if a nonwoven fabric of the type as shown in FIGS. 3 to 6 is cut along any longitudinal plane lying between the surfaces 2 and 2' in parallel thereto.

The nonwoven fabric of this invention constructed as hereinabove described usually has a thickness of about 0.5 to about 100 mm, and a basis weight of about 5 to about 2,000 g/m$^2$. It is preferably prepared from very fine fibers having a diameter usually in the range of about 0.1 to about 30$\mu$, preferably in the range of about 1 to about 20$\mu$ and more preferably in the range of about 2 to about 10$\mu$.

Although the nonwoven fabric of this invention can be made of any material without any limitation in particular, it is desirable to prepare it from a thermoplastic resin. Examples of the thermoplastic resin which can be used include polyolefins such as homopolymers of ethylene, propylene, butene-1, 4-methylpentene-1, or other $\alpha$-olefins, copolymers thereof, and the mixtures of those polymers, polyamides such as nylon 6, nylon 66, nylon 612, nylon 12 (trade or common names), and their mixtures, polyesters such as polyethylene terephthalate, polybutylene terephthalate, and polyurethane, particularly thermoplastic polyurethane, ethylene-vinyl acetate copolymers, ethylene-methacrylic acid ester copolymers , and graft copolymers of polyolefins with unsaturated carboxylic acids or their derivatives. It is also possible to use any mixture of those thermoplastic resins.

The nonwoven fabric of this invention may be manufactured by various methods. It is possible to prepare the surface layer 2 and the fibrous layer 3 separately, and combine them together, but it is more desirable to form them as an integral assembly in a single stage of operation. A preferred method for making the nonwoven fabric according to this invention will be described hereunder by way of example.

Referring to FIG. 8, a thermoplastic substance is fed into an extruder 5 through its hopper 11, and melted under heat in the extruder 5. The molten substance is fed through a die 6 provided on the extruder 5, and is continuously spun through spinning holes 61 in the die 6. The die 6 is provided on both sides of its spinning holes 61 adjacent thereto with gas emitting ports 62, and gas feeding tubes 63 for supplying a gas into the gas emitting ports 62. A high pressure gas supplied through the gas feeding tubes 63 is blown out through the gas emitting ports 62 at a speed which is close to that of sound. The thermoplastic substance spun through the spinning holes 61 is divided into fine fibers by the gas discharged through the gas emitting holes 62 at such a high speed, thereby forming a stream of fibers 7 with the gas. If required, a liquid drop supplying unit 10 is provided for supplying liquid drops toward the fiber stream 7. After the fiber stream 7 is contacted with such liquid drops (though such contact is not essentially required), the fiber stream 7 is blown against a fiber impinging portion P of a collector 8. The collector 8 comprises a net or porous plate of a synthetic resin having a mesh size of 5 to 200 mesh, preferably 5 to 100 mesh and more preferably 10 to 40 mesh, and wound about a hollow cylindrical drum 81. The drum 81 has a cylindrical side wall pierced with a multiplicity of apertures 83. Each of the apertures 83 perferably has an inwardly tapered longitudinal section, and is defined by an inner portion 84 and an outer portion 85 having a greater diameter than the inner portion 84 as shown in FIGS. 9 and 10. The apertures 83 are circular in cross section. The fibers blown against the surface of the collector 8 are separated from the fiber stream 7, and form a nonwoven fabric 1. The nonwoven fabric thus formed is compressed by a presser 9 into a predetermined thickness, and wound about a winder 13 after passing around rolls 71 and 71'. The presser 9 comprises a net or porous plate of the same nature as that of which the collector 8 is made, which net or plate extends about drums 91 and 91' of the same nature with the drum 81. A fiber collecting zone 12 is defined between the collector 8 and the presser 9. A spray 14 is provided for supplying a cooling fluid to the collector 8, if required.

The nonwoven fabric of this invention can be manufactured efficiently by the method as hereinabove described. FIG. 11 schematically illustrates the process by which the fibers form a fabric. When the fiber stream 7 formed by a plurality of long fibers is blown into the fiber collecting zone 12 defined between the collector 8 and the presser 9, the individual fibers are intertwined and stacked together to form a nonwoven fabric 1.

Figure 4:
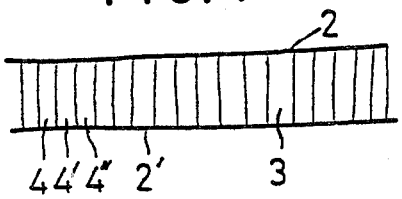
FIGS. 4 to 7 illustrate various forms of the nonwoven fabric of this invention at plane A in FIG. 1.
Figure 5:
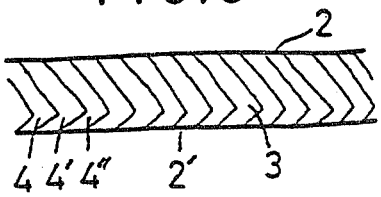
Figure 6:
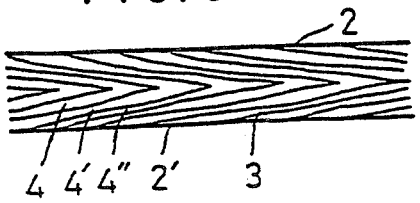
Figure 7:
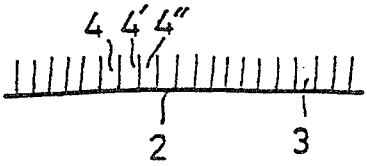

The longitudinal sectional plane of the nonwoven fabric 1 as shown at A in FIG. 1 may have various patterns as shown in FIGS. 3 to 7, which depend on the angle at which the fiber stream 7 is blown, and/or the relative position of the collector 8 and the presser 9. More specifically, if the fiber stream 7 is blown at a small angle, or if the collector 8 and the presser 9 are spaced a greater distance apart from each other, the thin layers 4, 4', 4'' have a tendency to lie generally straightly as shown in FIG. 4. If, on the contrary, the fiber stream 7 is blown at a large angle, or the collector 8 and the presser 9 are brought closer to each other, the thin layers 4, 4', 4'' each have an acutely bent shape as shown in FIG. 6.

The nonwoven fabric of this invention constructed as hereinabove described has a fine hand, and is bulky, and demonstrates excellent results not obtained from any known nonwoven fabric when used for making filter materials, carpets, substrates for synthetic leathers, or the like.

What is claimed is:

1. A nonwoven fabric consisting essentially of stacked and intertwined long fibers forming thin intertwined layers extending between one surface of said fabric or part thereof, and another surface of said fabric or part thereof.

2. A nonwoven fabric according to claim 1, wherein the fibers have a diameter of about 0.1 to about 30 microns.

3. A nonwoven fabric according to claim 1 having a basis weight of about 5 to 2,000 g/m$^2$.

4. A nonwoven fabric according to claim 1 having a thickness of about 0.5 to about 100 mm.

5. A nonwoven fabric consisting essentially of stacked and intertwined long fibers forming thin intertwined layers extending between one surface of said fabric or a part thereof and the other surface of said fabric or a part thereof, said fibers having a diameter of about 0.1 to 30 microns, said fabric having a basis weight of about 5 to about 2,000 g/m$^2$ and a thickness of about 0.5 to 100 mm.

* * * * *